US007747205B2

(12) United States Patent
Fujii

(10) Patent No.: US 7,747,205 B2
(45) Date of Patent: Jun. 29, 2010

(54) IMAGE FORMING APPARATUS HAVING FIXING DEVICE WITH AIR SEPARATOR THAT SEPARATES RECORDING MATERIAL FROM A HEATING MEMBER

(75) Inventor: Makoto Fujii, Hino (JP)

(73) Assignee: Konica Minolta Business Technologies, Inc. (JP)

( * ) Notice: Subject to any disclaimer, the term of this patent is extended or adjusted under 35 U.S.C. 154(b) by 818 days.

(21) Appl. No.: 11/518,675

(22) Filed: Sep. 11, 2006

(65) Prior Publication Data

US 2007/0147912 A1 Jun. 28, 2007

(30) Foreign Application Priority Data

Dec. 28, 2005 (JP) ..... 2005-377178

(51) Int. Cl.
*G03G 15/20* (2006.01)

(52) U.S. Cl. ..... 399/323; 399/398; 271/309; 271/900

(58) Field of Classification Search ..... 399/323, 399/398

See application file for complete search history.

(56) References Cited

U.S. PATENT DOCUMENTS

2004/0120735 A1 * 6/2004 Baba et al. ..... 399/323

FOREIGN PATENT DOCUMENTS

JP 60-247672 12/1985
JP 2005-157179 6/2005

* cited by examiner

*Primary Examiner*—David M Gray
*Assistant Examiner*—Ruth N Labombard
(74) *Attorney, Agent, or Firm*—Cantor Colburn LLP

(57) ABSTRACT

An image forming apparatus having a fixing device for fixing toner image on a recording material, the fixing device includes: a heating member which heats a recording material; a pressing member which comes into contact with the heating member with pressure; and an air separator which separates the recording material from the heating member by compressed air blown between a leading edge of the recording material and the heating member, the air separator includes a plurality of nozzles disposed in a width direction perpendicular to a conveyance direction of the recording material and an air emitting amount distribution setting section which unifies an emitting amount distribution in the width direction of the compressed air which is emitted from the nozzles.

5 Claims, 6 Drawing Sheets

IMAGE FORMING APPARATUS HAVING FIXING DEVICE WITH AIR SEPARATOR THAT SEPARATES RECORDING MATERIAL FROM A HEATING MEMBER

This application is based on Japanese Patent Application No. 2005-377178 filed on Dec. 28, 2005, which is hereby incorporated by reference.

BACKGROUND OF THE INVENTION

The present invention relates to an image forming apparatus and particularly relates to separation technology of recording material in a fixing device of an image forming apparatus.

An electrophotographic image forming apparatus, in general, includes a fixing device for fixing a toner image onto a recording material by giving heat and pressure to the toner image on the recording material by using a heat member and a pressing member.

In the fixing device of the image forming apparatus, due to the viscosity of the toner, which has been heated and melted, the recording material tends to adhere to the heating member. Thus, in order to separate the recording material from the heating member, a separator for separating the recording material after fixing operation from the heating member is used. With regard to the separator, a separation claw for mechanically exfoliating the leading edge of the recording material from the heating member is widely used. However there are problems that the separation claw hurts the surface of the heating member and deforms the recording material. Further the separation claw itself is deformed and results in deterioration of separation performance. Accordingly, the developments to solve these problems have been conducted.

Japanese Patent Application Publication No. 60-247672 and Japanese Patent Application Publication No. 2005-157179 have disclosed an air separator for blowing compressed air against the leading edge of the recording material.

The air separator disclosed in Japanese Patent Application Publication No. 60-247672 and Japanese Patent Application Publication No. 2005-157179 are effective as a separation device for solving the problems associated with the separation claw. However, a conventional air separator is not enough as a separator in the following points.

With regard to the width direction perpendicular to the conveyance direction of the recording material, when air emitting amount distribution is not appropriate, there is a problem that separation failure and flapping of the recording material occur.

When, conducting image formation by using a different type of structure of the fixing device, by using different operation modes of the image forming apparatus, and particularly conducting image formation onto different sizes of recording material, the air emitting amount distribution in the width direction of the recording material becomes different air emitting amount distributions. In a conventional art, the air emitting amount distribution has not been considered.

For example, Japanese Patent Application Publication No. 60-247672 disclosed an air separator having a plurality of nozzles disposed in width direction of the recording material, into one of the nozzle, air being supplied from an edge of a pipe. However, since the air emitting amount distribution becomes high in an end portion according to the structure, there is a problem that separation failure tends to occur.

SUMMARY OF THE INVENTION

An object of the present invention is to solve the problem of the claw separation by using an air separation unit. Further another object of the present invention is to provide an image forming apparatus capable of maintaining good separation performance and to provide recording material conveyance performance by solving the problem of the conventional air separation unit even though the structure of the fixing device is different and the operation mode of the image forming apparatus varies.

An object described above will be attained by any one of following configurations.

1. An image forming apparatus including a fixing device having a heating member for heating a recording material, a pressing member for coming into contact with the heating member with pressure and an air separator for separating the recording material from the heating member by compressed air blown between a leading edge of the recording material and the heating member, wherein the air separator includes a plurality of nozzles disposed in the width direction of the recording material perpendicular to the conveyance direction thereof and an air emitting amount distribution setting section for unifying air emitting amount distribution, the air being emitted from the nozzles in the width direction.

2. An image forming apparatus including a fixing device having heating member for heating a recording material, a pressing member for coming into contact with the heating member with pressure and an air separator for separating the recording material from the heating member by compressed air blown between a leading edge of the recording material and the heating member, wherein the image forming apparatus includes a conveyance unit for conveying the recording material with reference to a center of the recording material, and the air separator includes a plurality of nozzles disposed in the width direction of a recording material perpendicular to the conveyance direction thereof and an air emitting amount distribution setting section for controlling an air emitting amount distribution, the air being emitted from the nozzle, in the width direction of the recording material so that a center portion of the air emitting amount distribution in the width direction becomes high.

3. An image forming apparatus including a fixing device having a heating member for heating a recording material, a pressing member for coming into contact with the heating member with pressure and an air separator for separating the recording material from the heating member by compressed air blown between a leading edge of the recording material and the heating member, wherein the image forming apparatus includes a conveyance unit for conveying the recording material with reference to one side of the recording material, and the air separator includes a plurality of nozzles disposed in the width direction of the recording material perpendicular to the conveyance direction thereof and an air emitting amount distribution setting section for controlling an air emitting amount distribution in the width direction, the air being emitted from the nozzles so that the one side of the air emitting amount distribution in the width direction becomes high.

DESCRIPTION OF THE DRAWNGS

DETAILED DESCRIPTION OF THE PREFERRED EMBODIMENTS

Figure 1:
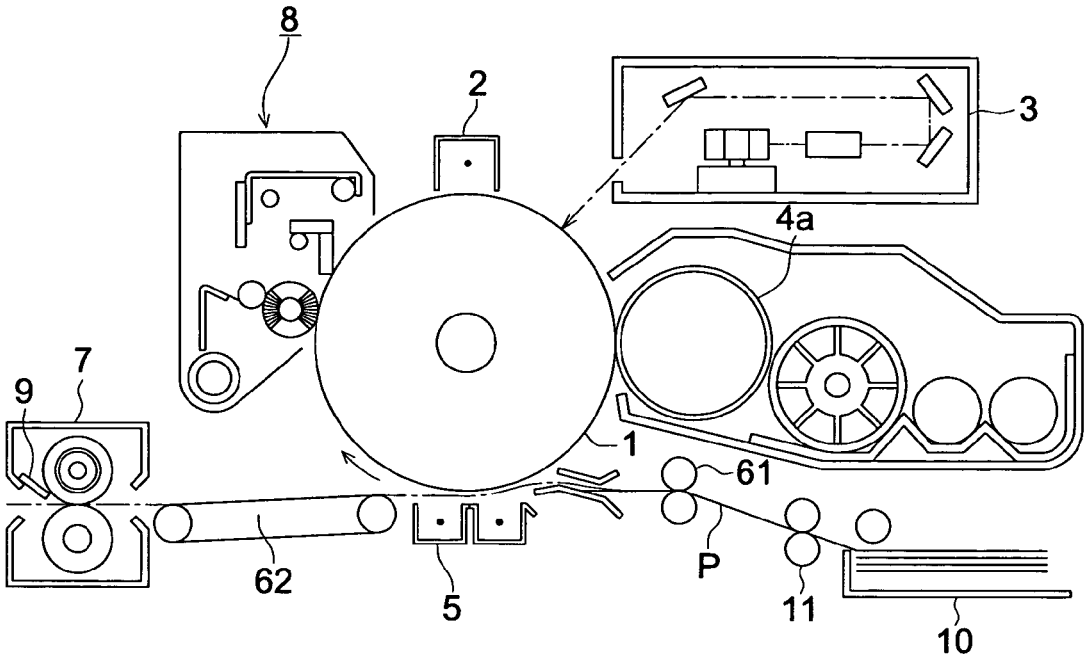
FIG. 1 illustrates a total view of an embodiment of the image forming apparatus of the present invention.

The present invention will be described based on embodiments illustrated in the drawings below. However, the present invention is not limited to the embodiments.

FIG. 1 illustrates a total view of an embodiment of the image forming apparatus of the present invention.

In FIG. 1, numeral 1 denotes a photoreceptor drum being an electrophotographic photoreceptor. The photoreceptor drum 1 is driven in an arrow direction at a predetermined circumferential speed and a charger 2 uniformly charges the surface of the photoreceptor drum 1 with a predetermined minus voltage VH.

A numeral 3 denotes an exposure unit for outputting laser beams modulated corresponding to the sequential digital image signals of the image information inputted from an image forming apparatus and a computer (not shown). The laser beams scans and exposes the surface of the uniformly charged photoreceptor drum 1. According to this operation, the absolute value of the voltage of the exposed portion in the photoreceptor drum comes down to a voltage VL and a latent image is formed on the surface of the photoreceptor drum 1.

A developing apparatus 4 is equipped with a developing roller 4*a*, which is driven to rotate. The developing roller 4*a* is disposed opposite to the photoreceptor drum 1 and a thin layer of toner onto which minus electric charges are charged is formed on the outer surface of the developing roller 4*a*. A developing bias voltage, the absolute value of which is smaller than the voltage VH of the photoreceptor drum and larger than the voltage VL is applied onto the developing roller 4*a*. Thus, the toner on the developing roller 4*a* adheres onto only the voltage VL portion of the photoreceptor drum and a reversal phenomenon occurs. As a result, a toner image is formed.

A conveyance member 11 conveys a recording material P stored in a recording material storage section 10. Then the recording material P is sent to a transfer area constituted by the photoreceptor drum 1 and a charged transfer unit 5 with an appropriate timing synchronizing to the rotation of the photoreceptor drum 1 through a registration roller 61. Then, the charged transfer unit 5 transfers the toner image on the photoreceptor drum onto the recording material P.

A numeral 62 denotes a guide to fixing device and the recording material P onto which a toner image has been transferred is conveyed to a fixing device 7 where the toner image transferred onto the recording material P is fixed. The recoding material P onto which the toner image has been fixed passes through the fixing device 7 and ejected onto an eject tray (not shown).

On the other hand, residual toner adhered on the surface of the photoreceptor drum 1 from which the recording material has been separated is removed by a cleaning unit 8 and the photoreceptor drum 1, which has been cleaned is repeatedly used for image formation.

The image forming apparatus described above is an apparatus for forming a monochrome image. However, the present invention may be applied to an apparatus for forming a color image.

Figure 2:
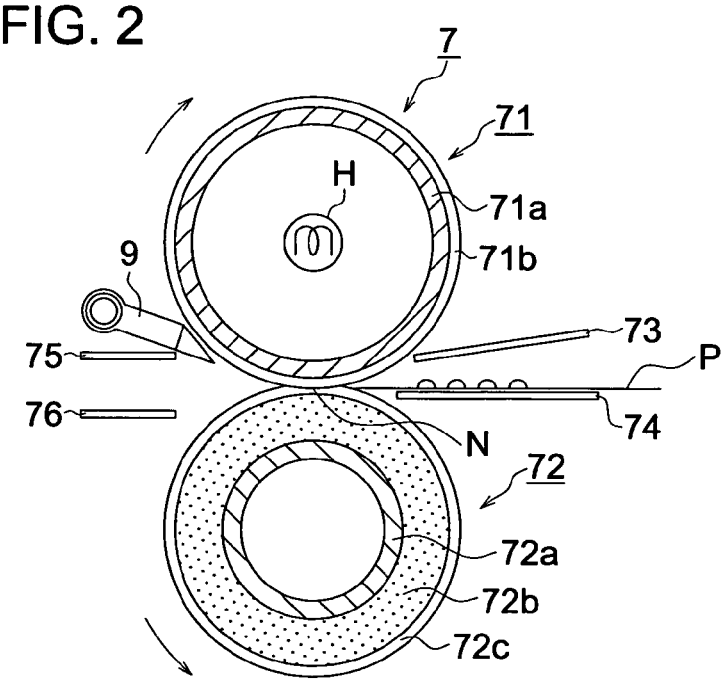
FIG. 2 illustrates a cross sectional view of the fixing unit.

Next, the fixing device 7 will be described in detail based on the cross sectional view illustrated in FIG. 2.

The fixing device 7 comprises a heating roller 71 as a heating member for heating the toner image on the recording material, the heating member being heated by a halogen heater H (a heater), and a pressing roller 72 as a pressing member for being in contact with the heating roller 71 with pressure from a lower direction.

The heating roller 71 comprises the halogen heater H provided in the center thereof, a core bar 71*a* formed by aluminum or iron in a cylindrical shape and a separation layer 71*b* covering the core bar 71*a* by coating or a tube thereof, the separation layer 71 being formed by fluorine resin such as PFA (Tetrafluoroethylene-perfluoroalkylvinylether copolymer) or PTFE (Polytetrafluoroethylene).

The pressing roller 72 comprises a core bar 72*a* formed by stainless steal into a cylindrical shape, an elastic layer 72*b* formed by a silicon rubber forming member, the elastic layer 72*b* being located on the outer surface of the core bar 72*a* and a separation layer 72*c* formed by the PFA tube, the separation layer 72*c* covering the elastic layer 72*b*. A forcing member (not shown) gives pressure onto the pressing roller 72. The pressing roller 72 is in contact with the heating roller 71 with pressure from the lower direction.

According to the structure described above, when a motor (not shown) rotates the heating roller 71 clockwise, the pressing roller 72 rotates counterclockwise. Accordingly, for example, the recording material P onto which a toner image has been formed by the image forming apparatus illustrated in FIG. 1 is nipped, conveyed, heated and pressed by a nip section N formed by the heating roller 71 and the heating roller 72. Based on this operation, the toner image of the recording material P is fixed.

When necessary, an induced heating method can be applied to the heating device of the heating roller 71. With regard to the heating member and the pressing member, a belt can be applied instead of a roller.

Here, in order to prevent the recording material P from winding around the heating roller 71 due to the adhesiveness of softened toner, which is toner of the toner image on the recording material P adhered on the heating roller 71, an air separator 9 for separating the leading edge of the recording material P wound around the heating roller 71 by the wind pressure of the air is provided in an ejected side of the recording material P against the nip section N. When the leading edge of the recording material P passes through the nip section N, pulsing compressed air is emitted from the air separator 9 to separate the recording material P from the heating roller 71.

Numerals 73 and 74 denote guide plates for guiding the recording material P to the fixing device 7. Numerals 75 and 76 denote guide plates for guiding the ejecting sheet to the fixing device 7.

Figure 3:
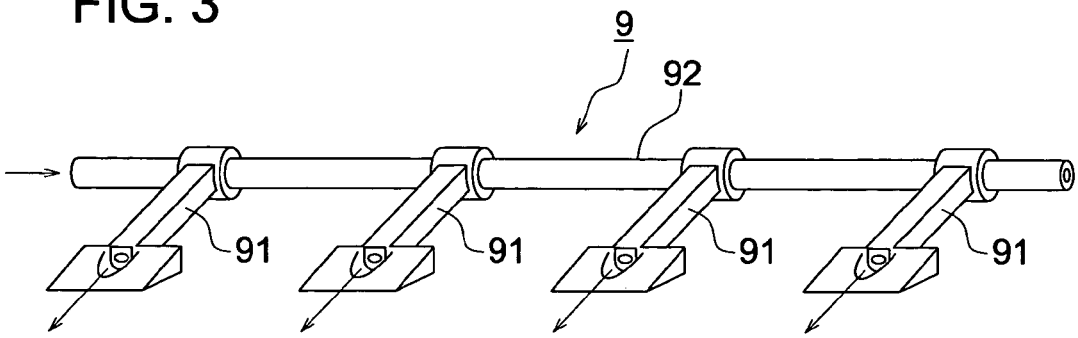
FIG. 3 illustrates a perspective view of the air separator.
Figure 4:
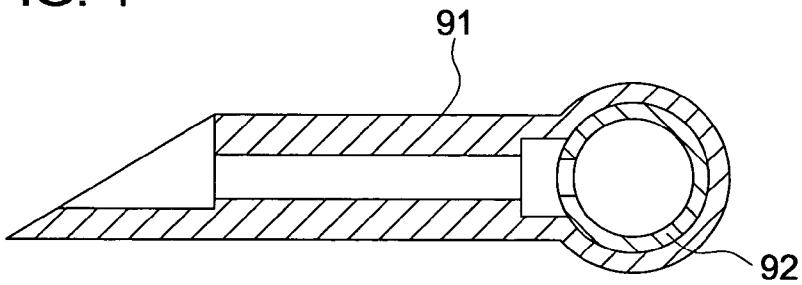
FIG. 4 illustrates a cross sectional view of the air separator.

This air separator 9 will be described based on FIGS. 3 and 4. FIG. 3 illustrates a perspective view of the air separator 9. FIG. 4 illustrates a cross sectional view of the air separator 9.

The air separator 9 comprises a plurality of nozzles 91 for emitting compressed air to the leading edge of the recording material P and a guiding pipe member 92 for sending air to the nozzles 91, the guiding pipe member 92 also supporting plural nozzles 91 disposed in the width direction perpendicular to the conveyance direction of the recording material P. The compressed air is supplied into the guiding pipe member 92 and air having a pressure capable of separating the recording material P from the heating roller 71 is emitted.

Before commencing the description of an embodiment of the present invention, the potential problems when using the air separator will be described below.

Figure 5:
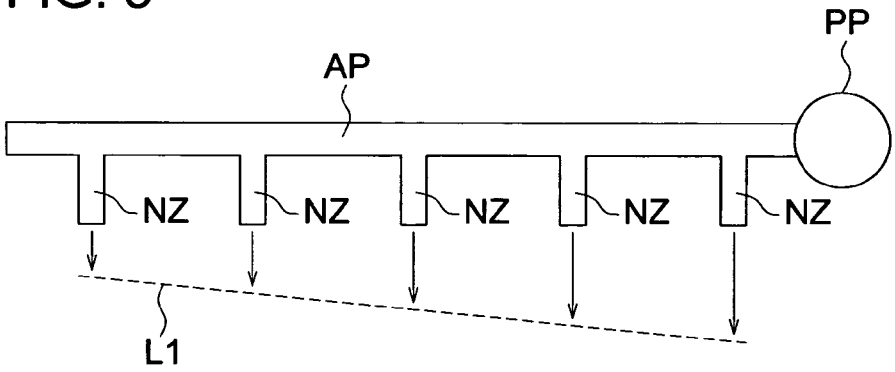
FIG. 5 illustrates an example of the air separator.

FIG. 5 illustrates an air separator having a guiding pipe AP with which a plurality of nozzles NZ is connected, one end of the guiding pipe Ap being connected with an air supplier PP configured by an air pump. An air emitting amount distribution setting section comprises disposed plural nozzles NZ, a common guiding pipe AP and an air supplier PP configured by an air pump.

With regard to the emitting nozzle shape of each nozzle NZ, even though the emitting nozzle shape of each nozzle NZ is arranged to have the same shape, emitting air amount from reach nozzle NZ is not uniform. As illustrated in a dotted line L1 showing an air emitting amount distribution in FIG. 5, the nearer position to the air supplier PP, where the nozzle NZ is located, the larger emitting amount becomes.

As a result, the separation performance of the air separator for the recording material in the width direction becomes non-uniform. Separation failure and recording material flapping tend to occur.

It is not always preferable that the air emitting amount from the nozzles NZ in the width direction is uniform. The aspect of a proper air emitting amount distribution varies according to the apparatus or various factors such as an operation mode of the apparatus. For example, there is a case that most preferable distribution is the distribution having its maximum emitting amount is set in the center portion of the recording conveyance width direction, or is the distribution having its maximum emitting amount is set at one end in the recording material width direction.

The present invention is to smoothly conduct separation and conveyance of the recording material in the fixing device, to suppress the occurrence of recording material jam in the fixing device and to prevent the occurrence of creasing and waving of the recording material, which tend to occur in the fixing device by adapting the air separator to the structure and the operation mode of the image forming apparatus in the image forming apparatus having an air separator. The concrete method for solving the problems will be described below.

(1) Embodiment 1

Figure 6:
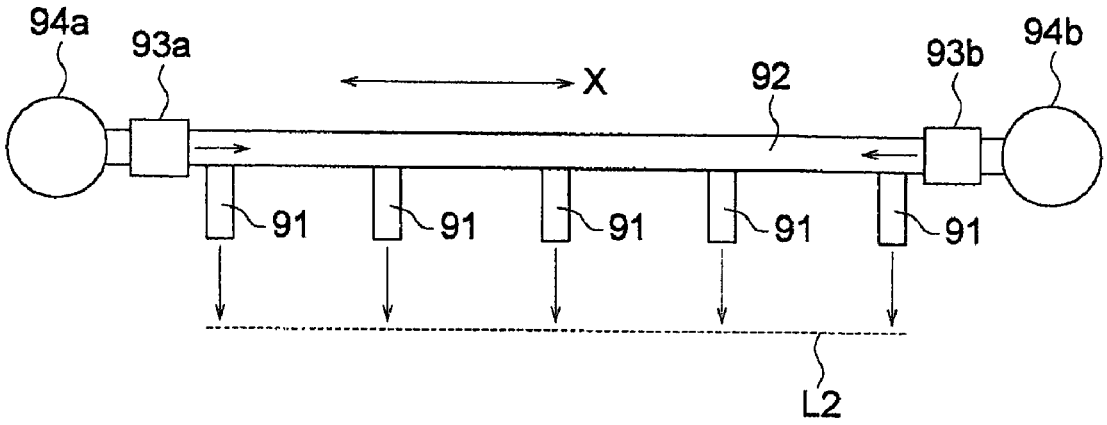
FIG. 6 illustrates the main portion of an embodiment 1 of the present invention.

FIG. 6 illustrates the main portion of the embodiment 1 of the present invention.

A plurality of nozzles 91, which are arrayed in the width direction, namely the X direction, which is orthogonal to the conveyance direction Y. The plurality of nozzles 91 are connected to a common guiding pipe 92 and compressed air is sent from an air pump 94*a* and an electro-magnetic valve 93*a* to one end of the guiding pipe 92.

An air pump 94*b* and an electro magnetic valve 93*b* are disposed at the other end of the guiding pipe 92. Air(Gas) is supplied from the both ends of the guiding pipe 92. Thus, as illustrated in a dotted line L2, air having a uniform air emitting amount distribution in the width direction X is emitted from the nozzles 91.

The disposed plurality of nozzles 91, the common guiding pipe 92, the air pumps 94*a*-94*b* and the electro magnetic valves 93*a*-93*b* constitute the air emitting amount distribution setting section.

By blowing air against the heating roller 71 with a uniform air emitting amount distribution in the recording material width direction, separation conveyance performance becomes stable, and the satisfied separation performance against the difference of the recording material size and the variation of environment can be obtained. Accordingly, this embodiment can provide an image forming apparatus capable of stably operating under the various environments and operation conditions.

(2) Embodiment 2

Figure 7:
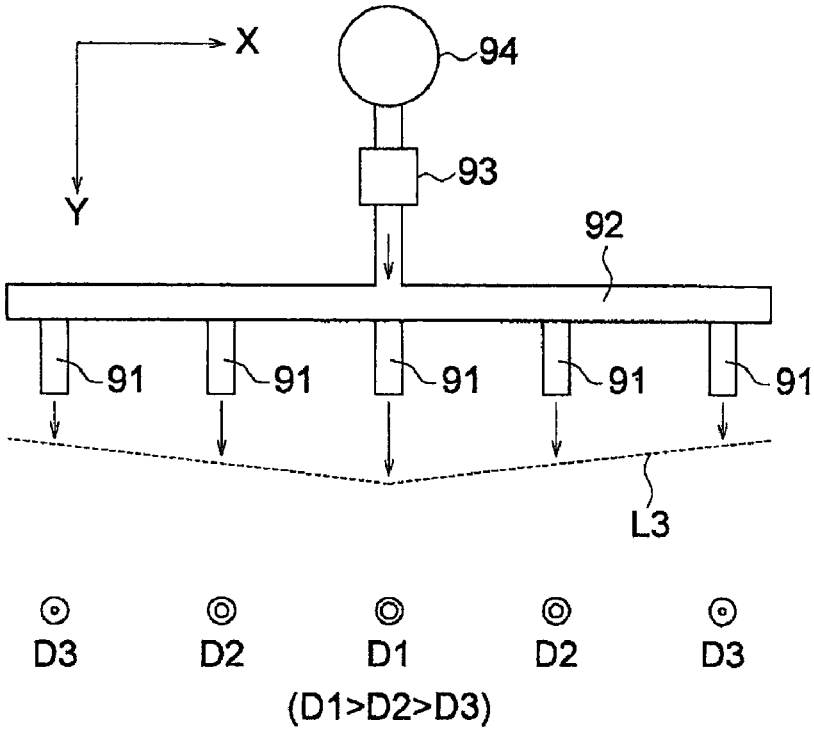
FIG. 7 illustrates the main portion of an embodiment 2 of the present invention.

FIG. 7 illustrates the main portion of the embodiment 2 of the present invention.

In this embodiment, an air pump 94 and an electro magnetic valve 93 are connected with a center portion of the guiding pipe 92 in the recording material width direction. The disposed plurality of nozzle 91, the common guiding pipe 92, the air pump 94 and the electro magnetic valve 93 constitute the air emitting amount distribution setting section.

According to this configuration, as illustrated in a dotted line L3, conducted is air blowing having the air emitting amount having a mountain shape air distribution in which the peak point is set in the center portion in the recording material width direction.

In this embodiment, when conducting image formation onto a large size recording material such as A3 size recording material and A4 size longitudinal (recording material conveyance with setting a longitudinal side of the recording material to the width direction), the separation starts from the center portion of the leading edge of the recording material in its width direction and the separation gradually proceeds toward the edge portions in the width direction. Accordingly, the flapping of the recording material tends to occur at a separation point in the air separator 9 can be well suppressed.

Figure 8:
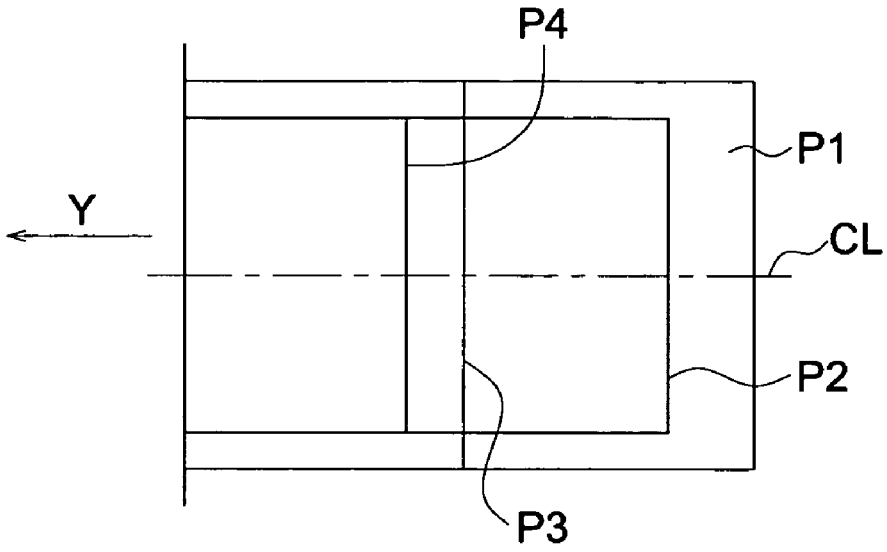
FIG. 8 illustrates an aspect of conveyance of the recording material.

The air separator illustrated in FIG. 7 can obtain satisfactory separation performances when applying to the image forming apparatus having a sheet conveyor with a center reference conveyance for conveying various size recording materials P1-P4 in the Y direction by referring to the centerline CL as illustrated in FIG. 8.

The conveyance having center reference as described above is conducted by the conveyance member 11 for conveying the recording material P from the recording material storage section 10 as illustrated in FIG. 1.

(3) Embodiment 3

Figure 9:
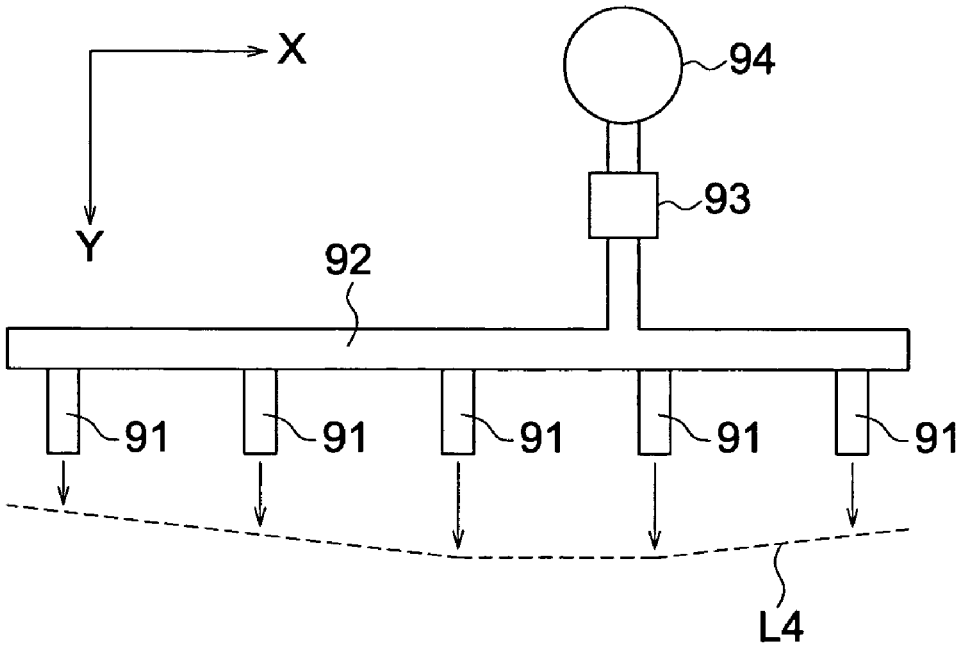
FIG. 9 illustrates the main portion of an embodiment 3 of the present invention.

FIG. 9 illustrates the main portion of the embodiment 3 of the present invention.

In the embodiment, as illustrated in FIG. 9, the air pump 94 and the electro magnetic valve 93 supply air to the guiding pipe 92 at the position being nearer to one end of the guiding pipe 92. The disposed plurality of nozzles 91, the common guiding pipe 92, the air pump 94 and the electro magnetic valve 93 constitute the air emitting amount distribution setting section. According to the structure described above, as illustrated in a dotted line L4, a sail type air emitting amount distribution having the peak of the air emitting amount at the position adjacent to the one end is formed.

Figure 10:
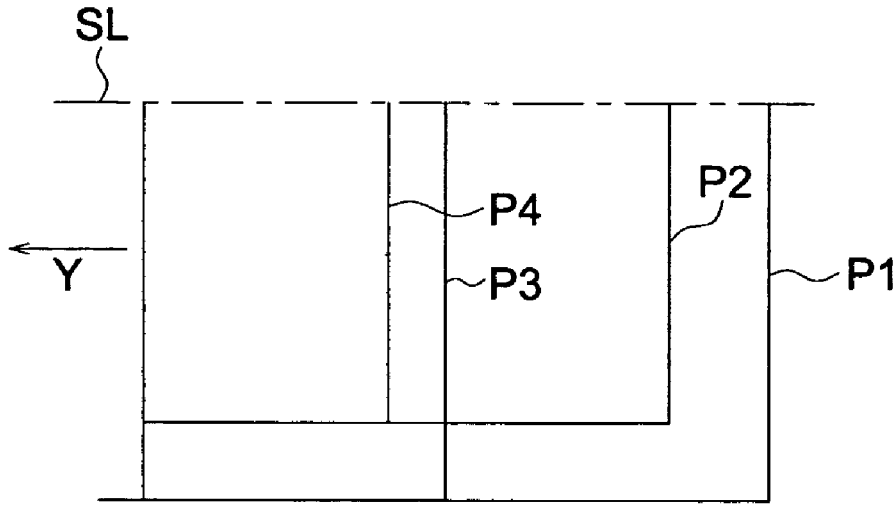
FIG. 10 illustrates an aspect of conveyance of the recording material.

The embodiment can be applied to the image forming apparatus having a sheet conveyor for conveying various size recording materials P1-P4 in the Y direction by referring to a standard line SL as illustrated in FIG. 10.

The conveyance referring to the one side reference is conducted in the sheet feeder 11 for supplying the recording material P from the recording material storage section 10 as illustrated in FIG. 1.

(4) Embodiment 4

Figure 11:
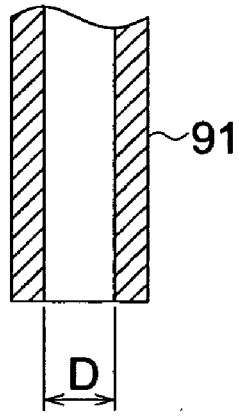
FIG. 11 illustrates the main portion of an embodiment 4 of the present invention.

FIG. 11 illustrates the main portion of the embodiment 4 of the present invention.

FIG. 11 illustrates a nozzle diameter of each of the nozzles 91. A required air emitting amount distribution can be formed by using nozzles having various different types of air emitting nozzle shapes.

For example, using a nozzle having a nozzle diameter larger than that of nozzles disposed both ends in the width direction can form the air emitting amount distribution illustrated in the dotted line L3 in FIG. 7. That is, a nozzle diameter D1 of the nozzle 91 positioned in the center is larger than a nozzle diameter D2 of the nozzle positioned next to the nozzle in the center, which is larger than a nozzle diameter D3 of the nozzle positioned next to the nozzle having the nozzle diameter D2 (i.e., D1>D2>D3). Even though, in the structure supplying air from one end of the guiding pipe AP as illustrated in FIG. 5, using different sizes of nozzle diameters of the nozzles located in the left end and right end of the guiding pipe AP can form a uniform air emitting amount distribution as illustrated in the dotted line L2 in FIG. 6.

(5) Embodiment 5

Figure 12:
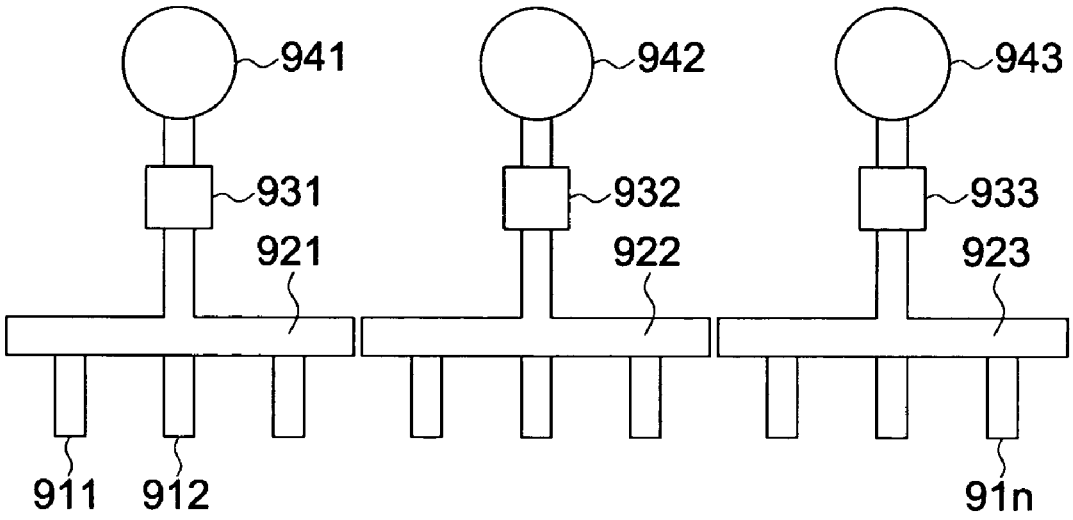
FIG. 12 illustrates the main portion of an embodiment 5 of the present invention.

FIG. 12 illustrates the main potion of the embodiment 5.

As illustrated in FIG. 12, plural nozzles 911-91*n* are grouped into a plurality of nozzle groups. Air pumps 941-943 and electro magnetic valves 931-933 are connected to each nozzle group through guiding pipes 921-923. The nozzles 911-91*n*, the guiding pipes 921-923, the air pumps 941-943 and the electro magnetic valves 931-933 constitute the air emitting amount distribution setting section.

In this configuration, controlling the output of air pumps 941-943 can set the air emitting amount distributions as illustrated in the dotted lines L2 in FIG. 6, L3 in FIG. 7 or L4 in FIG. 9.

As described above, various methods can form the required air emitting amount distribution.

With regard to the methods for applying the various methods described above to the image forming apparatus, there are following two methods.

The first method is to obtain the optimum air emitting amount distribution for the image forming apparatus and to dispose the optimum air separator. According to this method, after the air separator has been disposed in the image forming apparatus, basically the air emitting characteristic is not changed.

In the image forming apparatus having an air separator conducting recording material conveyance referring to the center line of the recording material, the air emitting amount distribution as illustrated in the dotted line L3 in FIG. 7 is set. In the image forming apparatus having an air separator conducting recording material conveyance referring to one side of the recording material, the air emitting amount distribution as illustrated in the dotted line L4 in FIG. 9 is set.

The second method is to adjust the air emitting characteristic after the air separator has been set in the image forming apparatus.

For example, the air emitting amount distribution of the air separator is changed corresponding to the size of the recording material onto which an image is formed. For example, when a large size recording material is used, the air emitting amount distribution illustrated in dotted line L3 in FIG. 7 is set. When a small size recording material is used, the air emitting amount distribution illustrated in dotted line L2 in FIG. 6 is set. According to these arrangements, the flapping tends to occur in the edge of the recording material can be prevented.

What is claimed is:

1. An image forming apparatus comprising:

a fixing device including a heating member which heats a recording material, a pressing member which comes into contact with the heating member with pressure, and an air separator which separates the recording material from the heating member by compressed air blown between a leading edge of the recording material and the heating member; and a conveyance member which conveys the recording material with reference to a center of the recording material in a width direction perpendicular to a conveyance direction of the recording material, wherein the air separator includes a plurality of nozzles disposed in the width direction and an air emitting amount distribution setting section which controls an emitting amount distribution in the width direction of the compressed air which is emitted from the nozzles so that a center portion of the air emitting amount distribution in the width direction becomes high; and wherein the air emitting amount distribution setting section sets the air emitting amount distribution by arranging each of the nozzles having a nozzle diameter different from each other.

2. The image forming apparatus of claim 1, wherein the air separator further comprises a guiding pipe member which sends the air to the nozzles and an air supplier which supplies the air to the guiding pipe member, and the air emitting amount distribution setting section comprises the air supplier which supplies the air from a center portion of the guiding pipe member in the width direction.

3. The image forming apparatus of claim 1, wherein the air emitting amount distribution setting section comprises a plurality of air suppliers each supplying the air to each of a plurality of nozzle groups.

4. The image forming apparatus of claim 1, wherein the air emitting amount distribution setting section is capable of changing the air emitting amount distribution.

5. The image forming apparatus of claim 1, wherein the air emitting amount distribution setting section is capable of changing the air emitting amount distribution according to a size of the recording material to be used.

* * * * *